United States Patent [19]

Valiulis

[11] Patent Number: 4,724,967

[45] Date of Patent: Feb. 16, 1988

[54] DISPLAY HANGER

[75] Inventor: Stanley C. Valiulis, Rockford, Ill.

[73] Assignee: Southern Imperial, Inc., Rockford, Ill.

[21] Appl. No.: 151

[22] Filed: Jan. 2, 1987

[51] Int. Cl.[4] ..... A47F 5/08

[52] U.S. Cl. ..... 211/59.1; 206/493; 211/106; 248/220.2; 248/225.1

[58] Field of Search ..... 211/57.1, 59.1, 106, 211/87, 94; 248/220.2, 220.4, 225.1, 225.2, 214, 215; 206/493

[56] References Cited

U.S. PATENT DOCUMENTS

| | | | |
|---|---|---|---|
| 2,665,869 | 1/1954 | Samuels | 211/59.1 |
| 3,172,539 | 3/1965 | Rulf | 211/59.1 |
| 3,200,960 | 8/1965 | Banse | 248/220.4 X |
| 3,424,421 | 1/1969 | Kalbow et al. | 248/220.4 X |
| 4,560,062 | 12/1985 | Valiulis | 206/44 R |

FOREIGN PATENT DOCUMENTS

| | | | |
|---|---|---|---|
| 192083 | 9/1957 | Fed. Rep. of Germany | 248/214 |
| 332790 | 6/1903 | France | 248/214 |
| 6606178 | 11/1966 | Netherlands | 211/106 |

*Primary Examiner*—Robert W. Gibson, Jr.
*Attorney, Agent, or Firm*—Leydig, Voit & Mayer

[57] ABSTRACT

The inner end portion of a wire hanger of the loop hook type is formed with a pair of downwardly opening hooks which enable the hanger to be attached universally to a grid-type rack, to a flat elongated bar or to the side panel of a paperboard merchandise carton.

5 Claims, 5 Drawing Figures

DISPLAY HANGER

BACKGROUND OF THE INVENTION

This invention relates to an elongated hanger adapted to be hung on a display member and adapted to support one or more articles.

More specifically, the invention relates to a hanger which is in the form of a so-called "loop hook" of the same general type as disclosed in Valiulis U.S. Pat. No. 4,560,062. A loop hook is formed by bending a single length of wire into a generally U-shaped configuration and by forming the free end portions of the wire with means for hanging the hook from a display member.

A hanger in the form of a loop hook is advantageous insofar as it can be made inexpensively from a single piece of wire and requires no separate supporting bracket and no welding or other assembly operations. In addition, the free end of a loop hook is rounded and blunt and thus there is less danger of injury, and particularly eye or facial injury, to a person who might run into the hanger.

SUMMARY OF THE INVENTION

The primary aim of the present invention is to provide a new and improved loop hook which is capable of being attached releasably to several different types of display members.

Another object of the invention is to provide a loop hook which may be attached universally to a grid-type display rack, to a flat display bar or directly to a paperboard merchandise carton.

A more detailed object of the invention is to provide a novel hanger in the form of a loop hook having unique hook-like elements enabling the hanger to be attached to various types of display members.

These and other objects and advantages of the invention will become more apparent from the following detailed description when taken in conjunction with the accompanying drawings.

DETAILED DESCRIPTION OF THE PREFERRED EMBODIMENT

The present invention is incorporated in a hanger 10 for supporting articles 11 such as merchandise from a display member 12. Typically, each article comprises a card having an elongated slot 13 therein for receiving the hanger. The hangers find greatest use in retail outlets such as hardware stores, drug stores or the like.

Figure 1:
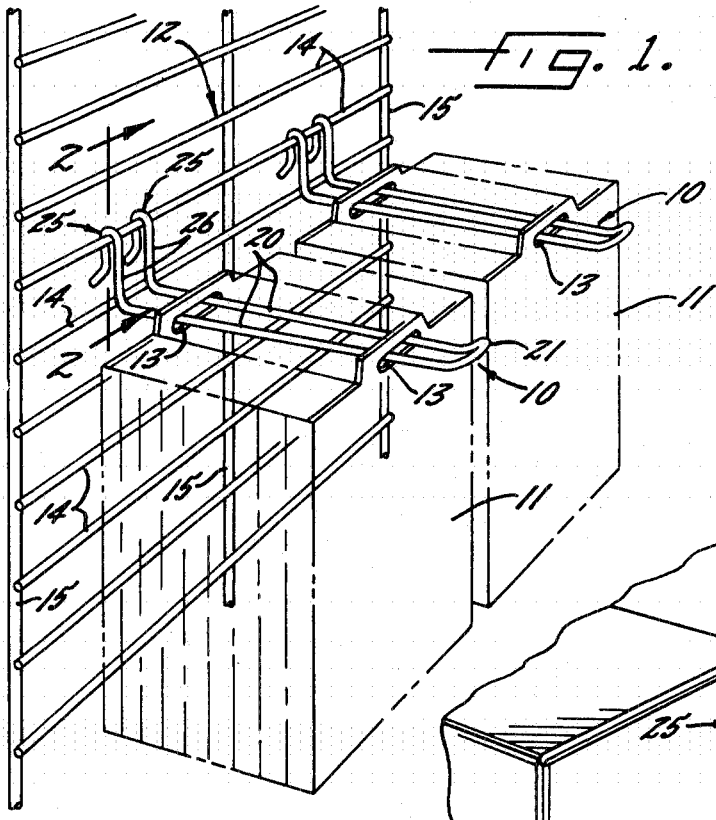
FIG. 1 is a perspective view showing new and improved hangers incorporating the unique features of the present invention attached to a grid-type display rack.
Figure 2:
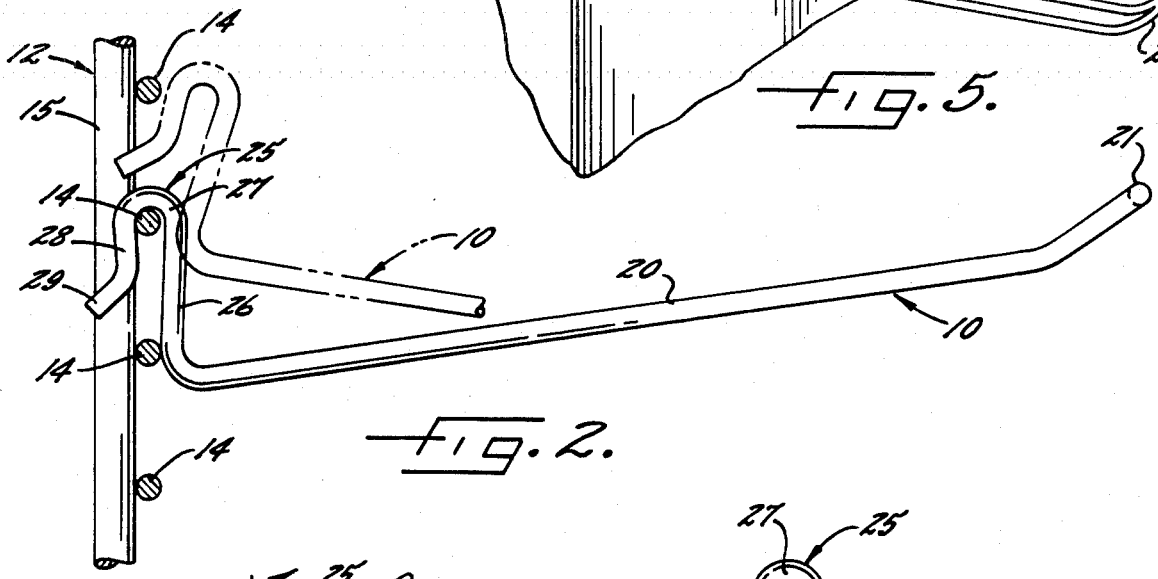
FIG. 2 is an enlarged fragmentary cross-section taken substantially along the line 2—2 of FIG. 1.

The display member 12 which has been shown in FIGS. 1 and 2 is in the form of a grid-type rack. In this instance, the rack 12 is formed by several horizontally extending and vertically spaced rods 14 which are interconnected by three vertically extending and horizontally spaced rods 15, the horizontal rods being welded rigidly to the vertical rods.

Figure 5:
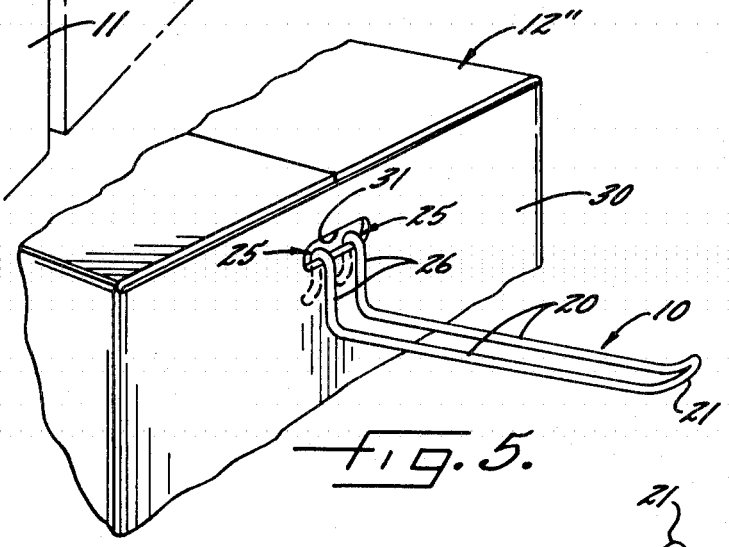
FIG. 5 is a perspective view showing the hanger attached to a paperboard carton.
Figure 3:
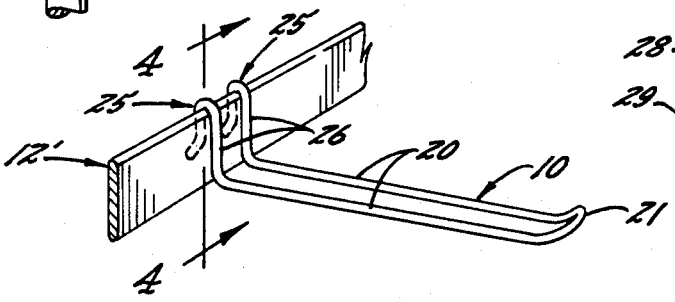
FIG. 3 is a perspective view showing a hanger attached to a flat display bar.

In accordance with the present invention, the hanger 10 consists of a single piece of wire bent generally in the form of a loop hook and uniquely shaped so as to enable the hanger to be attached releasably to several different types of display members 12, 12' and 12" (FIGS. 1, 3 and 5). The hanger thus may be used in a substantially universal manner so as to enable retail outlets to reduce the number of different types of hangers while still being able to utilize various kinds of display members.

Specifically, the present hanger 10 is made of round steel wire having a diameter of about ⅛". The wire is bent so as to form two laterally spaced and generally horizontally projecting hanger arm sections 20 adapted to extend outwardly from the display rack 12 and adapted to extend through the slots 13 in the merchandise cards 11. The outer end portions of the arm sections 20 are bent laterally and reversely toward one another and define a convexly rounded tip portion 21 at the extreme outer end of the hanger 10. Thus, when viewed from above, the hanger arms and the tip define a generally U-shaped configuration. Preferably, the tip portion 21 is inclined upwardly and outwardly from the major length of the hanger arm sections 20 as shown in FIG. 2. In addition, the hanger arm sections slant upwardly as they progress outwardly. The upward inclination of the tip portion 21 together with the upward inclination of the hanger arm sections 20 helps retain cards 11 on the hanger 10.

In carrying out the invention, unique hooks 25 are formed at the inner ends of the hanger arm sections 20 and enable the hanger 10 to be attached releasably to the display rack 12. Herein, each hook 25 is of a generally inverted J-shaped configuration when viewed from the side and comprises an upright leg 26 (FIG. 2) formed integrally with and projecting upwardly from the inner end portion of the hanger arm section 20. Formed integrally with the upper end of each leg 26 is an upwardly convex and downwardly concave arcuate section 27 which curves upwardly, inwardly and then downwardly from the leg. A finger 28 is formed integrally with and extends downwardly from each arcuate section 27, the finger being spaced inwardly from the leg 26 and being significantly shorter in length than the leg. Each hook 25 is completed by an end tang 29 formed integrally with and inclined downwardly and inwardly from the lower end of the respective finger 28. The combined length of the finger 28 and the tang 29 is less than the length of the leg 26.

With the foregoing arrangement, the hanger 10 may be attached to the display rack 12 simply by tilting the outer end portion of the hanger downwardly as shown in phantom lines in FIG. 2 and then by shifting the hanger downwardly to cause the hooks 25 to straddle one of the horizontal rods 14 of the rack as shown in solid lines. As is apparent, the lower end portions of the legs 26 engage the outer side of the rod 14 immediately below the rod which is straddled by the hooks 25 and thus the legs and the lower rod coact to stabilize the hanger 10 in the position shown in solid lines in FIG. 2. By tilting the hanger as shown in phantom lines during installation, the upper end portions of the hooks 25 clear the rod 14 immediately above the rod which is subsequently straddled by the hooks. When the hooks are pushed downwardly onto the latter rod, the flared throats defined between the legs 26 and the slanted tangs 29 facilitate reception of the rod by the hooks.

By tilting the hanger 10 upwardly, the hanger may be folded against the rack and shipped in an assembled but flat position with the rack. Such upward tilting is permitted by virtue of the combined length of the finger 28 and the tang 29 being less than the vertical spacing between adjacent horizontal rods 14.

Figure 4:
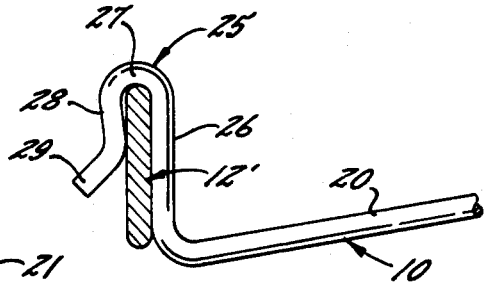
FIG. 4 is an enlarged fragmentary cross-section taken substantially along the line 4—4 of FIG. 3.

In FIGS. 3 and 4, the hanger 10 is shown as being attached to a display member 12' which is in the form of an elongated and horizontally extending bar disposed in a vertical plane and having flat inner and outer sides, the thickness of the bar being substantially less than the height thereof. As shown in FIG. 4, the leg 26 of each hook 25 lies in close face-to-face relation with the outer side of the bar 12'; the arcuate section 27 of each hook is hooked around the upper edge portion of the bar; and the lower end of each finger 28 engages the inner side of the bar at a point where the finger joins the tang 29. Such engagement prevents the hanger from being pivoted upwardly and accidentally knocked off of the bar.

FIG. 5 shows the hanger 10 in conjunction with a display member 12" in the form of a paperboard carton which may hold a large supply of articles 11 of the type supported on the hanger. The carton 12" includes an upright side panel 30 having a horizontally elongated slot 31 formed therethrough. When the hanger 10 is attached to the panel 30, the legs 26 of the hooks 25 lie in close face-to-face relation with the outer side of the panel while the arcuate sections 27 of the hooks extend through the slot 31 and are hooked around the lower edge portion thereof. The fingers 28 of the hooks engage the inner side of the panel much in the same manner as the fingers engage the inner side of the bar 12' of FIG. 4.

From the foregoing, it will be apparent that the present invention brings to the art a new and improved hanger 10 which is capable of being attached universally to a grid-type rack 12, to an elongated bar 12' or to the panel 30 of a merchandise carton 12". The hanger is extremely simple and may be manufactured very easily and economically. When the hanger is used with the grip-type rack 12, the hanger may be positioned in front of one of the vertical rods 25 with the hooks 25 straddling such rod.

I claim:

1. The combination of, a display member comprising a paperboard carton having an upright panel with inner and outer sides, there being a horizontally elongated slot formed through said panel, and a hanger attached releasably to said panel and adapted to support articles, said hanger being formed from a single piece of wire which is bent so as to define first and second elongated and laterally spaced hanger arm sections having inner and outer end portions, said hanger arm sections extending outwardly and generally horizontally from the outer side of said panel, the outer end portions of said hanger arm sections being bent convexly and being integrally joined so as to define a convexly rounded tip at the extreme outer end of said hanger, said hanger arm sections and said tip defining a generally U-shaped configuration when said hanger is viewed from above, and first and second hooks formed integrally with the inner end portions of said first and second hanger arm sections, respectively, each of said hooks defining a generally inverted J-shaped configuration when said hanger is viewed from the side, each of said hooks comprising (1) an upright leg formed integrally with and projecting upwardly from the inner end portion of the respective hanger arm section and extending upwardly along the outer side of said panel in close face-to-face relation with the outer side of said panel, (2) an upwardly convex and downwardly concave arcuate section formed integrally with and extending upwardly, inwardly and then downwardly from the upper end of the respective leg, said arcuate sections extending through said slot and being hooked around the lower edge portion thereof, and (3) a finger formed integrally with and projecting downwardly from the respective arcuate section and extending downwardly along the inner side of said panel, each finger being spaced inwardly from its respective leg and being significantly shorter in length than such leg.

2. A hanger as defined in claim 1 in which said hanger arm sections are inclined upwardly relative to said legs.

3. A hanger as defined in claim 2 in which the outer end portions of said hanger arm sections are bent upwardly relative to the major length of said hanger arm sections.

4. The combination defined in claim 1 in which each of said hooks further includes a tang formed integrally with and inclined downwardly and inwardly from the lower end of the respective finger.

5. The combination as defined in claim 1 in which the lower end portions of said fingers engage the inner side of said panel.

* * * * *